United States Patent [19]

Shannon

[11] Patent Number: 4,751,049

[45] Date of Patent: Jun. 14, 1988

[54] CONNECTOR AND ALLOY

[76] Inventor: John K. Shannon, 200 S. Vincennes Cir., Racine, Wis. 53402

[21] Appl. No.: 47,591

[22] Filed: May 6, 1987

Related U.S. Application Data

[63] Continuation of Ser. No. 752,121, Jul. 5, 1985, abandoned.

[51] Int. Cl.[4] ..... C22C 9/04

[52] U.S. Cl. ..... 420/477; 420/490

[58] Field of Search ..... 420/477, 490; 439/726, 439/727, 764, 784

[56] References Cited

U.S. PATENT DOCUMENTS

| | | | |
|---|---|---|---|
| 1,933,390 | 10/1933 | Ray et al. | 420/477 |
| 2,058,886 | 10/1936 | Jennison | 420/477 |
| 2,075,005 | 3/1937 | Bassett | 420/477 |
| 2,126,246 | 8/1938 | Deitz et al. | 420/477 |
| 3,205,472 | 9/1965 | Shannon | 339/232 |
| 3,377,609 | 4/1968 | Shannon et al. | 339/270 R |

FOREIGN PATENT DOCUMENTS

| | | | |
|---|---|---|---|
| 125221 | 11/1978 | Japan | 420/477 |
| 96040 | 8/1981 | Japan | 420/477 |

OTHER PUBLICATIONS

Lund, "Brass and Bronze Die Casting", Die Casting Engineer, Jul./Aug. 1986, p. 28.

*Primary Examiner*—R. Dean
*Assistant Examiner*—Robert L. McDowell
*Attorney, Agent, or Firm*—Michael J. Weins; Janine J. Weins

[57] ABSTRACT

Connectors which are essentially, by weight, 85% to 93% copper, with silicon in the amount of 1.5% to 2.5% is disclosed. The balance of the material is zinc, desirably in the range of 5% to 12%. Trace elements of tin, lead and aluminum can be tolerated but should be minimized to less than 0.05%. Ideally the material is 81% to 91% copper, 1.75% to 2.4% silicon and the balance zinc of 6% to 10%. The traces may be 0.05% tin, 0.01% lead, and 0.005% aluminum.

6 Claims, 1 Drawing Sheet

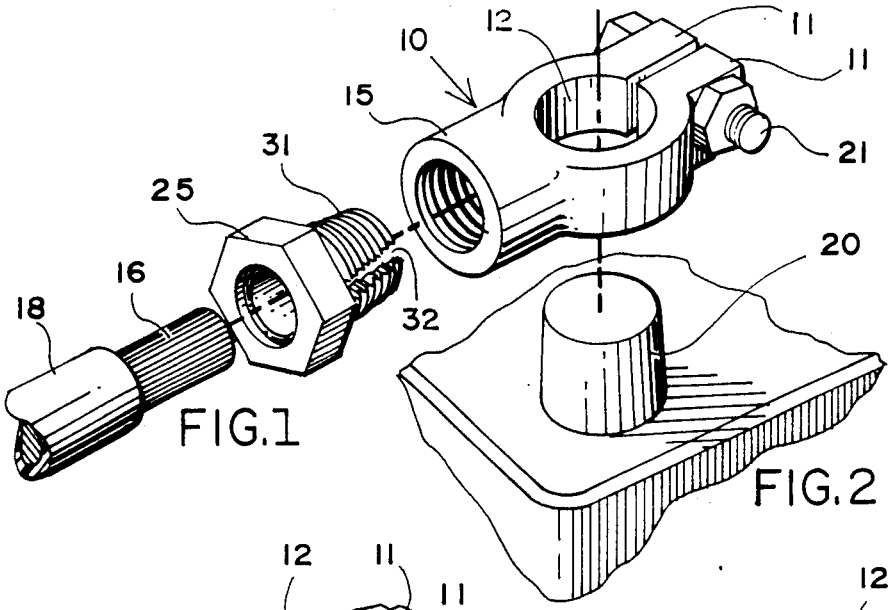
FIG. 1
FIG. 2
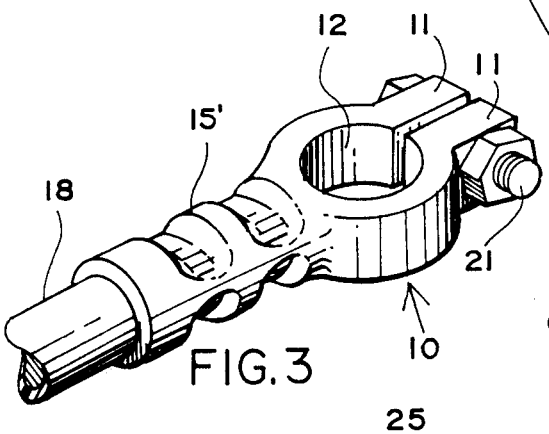
FIG. 3
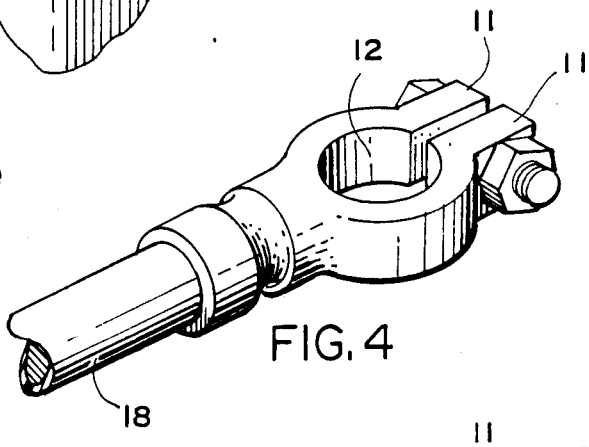
FIG. 4
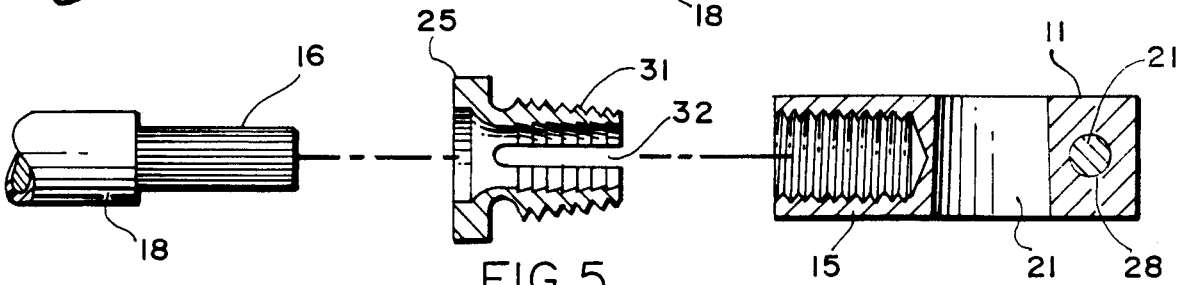
FIG. 5
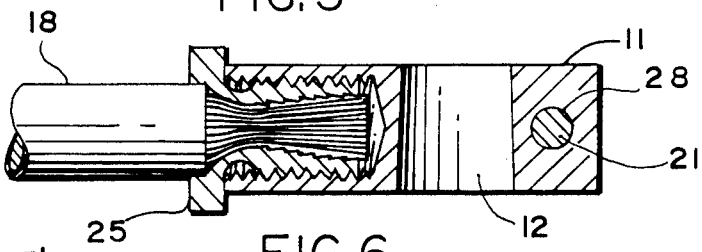
FIG. 6
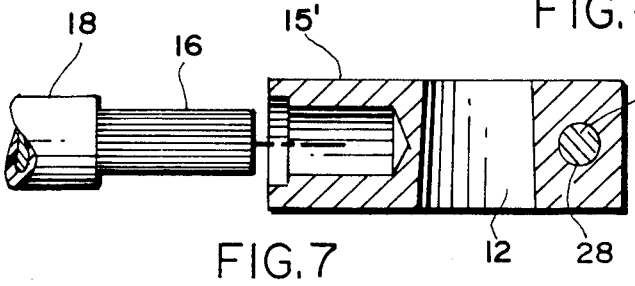
FIG. 7
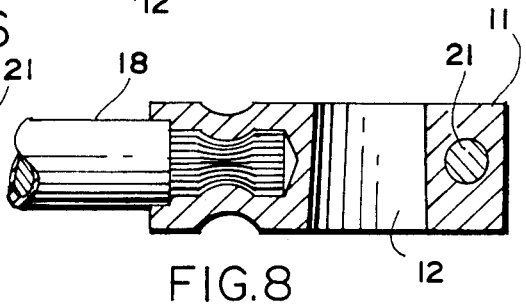
FIG. 8

CONNECTOR AND ALLOY

This application is a continuation of application Ser. No. 752,121, filed July 5, 1985, now abandoned.

BACKGROUND OF THE INVENTION

Field of the Invention

The present invention relates to connectors in general, but with considerable application to the types used in automotive equipment. More specifically the invention is directed to a terminal connector which joins a cable to a terminal, and the terminal is secured to a battery post, starter motor terminal or ground.

SUMMARY OF THE PRIOR ART

Most battery terminal connectors are made of lead or lead alloys. Lead is soft and malleable, and readily castable. It also has fairly good electrical properties. On the other hand, where a lead terminal is secured to a lead battery post, corrosion at the interface can take place and appreciably reduce conductivity. It could be crimped onto a cable, but it is too soft and weak to properly secure a cable even for light duty service.

Other battery terminals are made of copper alloys and cast in sand patterns. One such alloy, often referred to as Red Brass, is essentially 90% to 93% copper, 4% to 6% zinc, with approximately 1.5% lead and 1.5% tin. This bronze-like material, however, is difficult to die cast, and therefore less likely to gain the cost reduction advantage of permanent mold die casting. Moreover, with sand casting wall thickness is difficult to control. Therefore, there is a likelihood of break-out or cracking upon crimping, and similarly a likelihood of break-out or cracking when a compression nut is used.

Other such alloys, sometimes referred to as Yellow Brasses, also serve as the material from which battery terminal connectors are die cast. Yellow Brass has a zinc content over 10%, are distinguished from bronze in which the zinc content is normally less than 10%, and is not as ductal as Red Brass. Furthermore, it is likely to crack when crimped, although its expansion properties are fair where a compression nut is used to secure the same to the terminal and cable.

One particular copper alloy, known as C-87400 deriving from a family of silicon brasses, has been used for die casting battery terminal connectors. Produced by R. Lavin and Sons, Inc., 3426 South Kedsey Avenue, Chicago, Ill. 60623 and other copper alloy companies, this brass is 83% copper, 14% zinc and approximately 2.5% to 4.0% silicon. Though this copper alloy has many of the desireable qualities needed for casting battery terminal connectors, it is so hard and strong that it cannot be readily crimped by crimping tools already in the marketplace.

In a copper alloy, as the amount of silicon decreases, malleability increases. On the other hand, as the amount of silicon decreases, the release properties after molding degrade substantially. Higher copper concentrations can make the mold too hot for acceptable die casting. Thus, silicon lowers the melting point thereby improving the castability of silicon brass, yet results in hardened output which is difficult to crimp.

What is desired in a battery terminal connector material is an alloy which is readily castable, and soft enough to crimp at the female pocket where the cable is inserted into the terminal. It should be sufficiently malleable to crimp without cracking and such that the cross holes in the clamping jaws can be punched. The alloy should be machineable so that the connector terminal can be threaded for use with collet-like threaded compression nuts of the type produced by Quick-Cable Corporation, 2501 Eaton Lane, Racine, Wis. 53404 such as exemplified in U.S. Pat. Nos. 3,205,472 and 3,377,609. The terminal should be sufficiently ductile that it does not crack when it is applied to a compression nut having a cable in it. Furthermore, the interface between brass and lead, in comparison to lead to lead, is less likely to corrode and therefore maintain good electrical properties, even though the exterior of the clamp may corrode.

None of the known die castable copper alloys are sufficiently soft and ductile to crimp with conventional hand crimping tools already in the marketplace. All of the known die castable copper alloys are too hard, too strong or otherwise do not exhibit the properties as set forth above.

In summary, the properties which are most desirable for a battery terminal connector are: first, that it be die cast compatible to hold cost down and maintain casting tolerances within good dimensional limitations; second, it must also be corrosion resistant, not only upon its exterior, but at the interface with the cable and at the battery post; third, the material of the terminal connector must, without cracking, crimp readily with crimping tools already in the marketplace; fourth, it should withstand the expansion forces of compression nuts without cracking or expanding too easily; and finally, like all good products, it must be cost effective when compared with other known battery terminals and materials.

SUMMARY OF THE INVENTION

The present invention is directed to connectors which are essentially, by weight, 85% to 93% copper, with silicon in the amount of 1.5% to 2.5%. The balance of the material is zinc, desireably in the range of %5 to 12%. Trace elements of tin, lead and aluminum can be tolerated but should be minimized to less than 0.05%. Ideally the material is 88% to 91% copper, 1.75% to 2.4% silicon and the balance zinc of 6% to 10%. The traces may be 0.05% tin, 0.01% lead, and 0.005% aluminum.

In view of the foregoing, it is a principal object of the present invention to provide an alloy for a terminal connector which is soft enough to crimp with the existing crimping tools in the marketplace, threadable for collet-like compression fittings, adaptable to punching the cross-holes in the battery terminal clamp jaws, and ductile.

Yet another object of the present invention looks to the provision of such a battery terminal which is highly electrically conductive and which is inherently resistant to corrosion on the interface between the connector and a terminal post, so that electrical continuity continues with a minimum of maintenance.

Still another object of the present invention is to provide a battery terminal connector, starter and ground cable connector with all of the above properties which is inherently inexpensive due to the cost of the alloying ingredients, and due to the fact that it can be readily die cast.

BRIEF DESCRIPTION OF THE DRAWINGS

Further objects and advantages of the present invention will become apparent as the following description proceeds, taken in conjunction with the accompanying drawings, in which:

FIG. 1 is a perspective exploded view of a battery terminal connector and compression nut and connector barrel;

FIG. 2 is an alternative perspective view showing a stripped cable crimped in place in the connector barrel of the terminal;

FIG. 3 is an alternative showing of the crimping where it is essentially uniform around the periphery of the barrel;

FIG. 4 is a partial longitudinal section view of the crimp style shown in FIG. 2;

FIG. 5 is a longitudinal sectional view in exploded relationship of the terminal connector and compression nut of FIG. 1;

FIG. 6 is a subsequent view of the construction shown in FIG. 5 after the compression nut has engaged the stripped end of the cable, and after the barrel, although slightly expanded, has caused the compression nut to close in a collet-like fashion to grip the cable;

FIG. 7 is a longitudinal sectional view of a stripped cable and barrel intended for crimping in exploded relationship; and FIG. 8 is a view comparable to FIG. 7 showing the stripped end of the cable after being crimped with a single crimp as distinguished from the double crimp as shown in FIG. 2.

DESCRIPTION OF PREFERRED EMBODIMENTS

As noted in FIG. 1, the typical battery post terminal connector 10 includes a pair of jaws 11, a terminal recess 12 which is slightly frustoconical, and a cable connector portion 15 which is barrel-like. With this particular construction the cable connector 10 is intended to be secured onto the stripped end 16 of a battery cable 18.

The stripped end 16 of the cable 18 is inserted into the compression nut 25 and the threaded barrel portion 15 of the connector 10 is then screwed onto the compression nut 25. As shown in FIG. 6, the compression nut closes in a collet-like fashion compressing against the stripped end 16 of the cable 18. As the tapered end 31 of the compression nut 25 compresses, forces are exerted against the barrel 15, which tend to expand the barrel. The barrel must be strong and ductile enough to withstand these forces.

The battery terminal post 20 is received in the opening 12 defined by opposed jaws 11, and a clamping bolt 21 is employed to secure the same to battery post 20.

The alternative embodiment terminal 10′ is shown in FIGS. 2, 7, and 8. There the cable connector barrel 15′ is essentially tubular in configuration. As shown in FIG. 7, the stripped end 16 of the cable is inserted directly into the interior of the barrel 15′, and thereafter as shown in FIG. 8, crimped into locking relationship.

As shown in FIGS. 3 and 4, the crimping can be done in a 360° fashion as shown in FIG. 3, or at opposed diametrical positions as shown in FIGS. 2 and 4.

When the compression nut 25 is used, it necessarily will tend to expand the walls of the barrel connector 15. In this process, certain alloys will permit crimping but not tolerate expansion. Other alloys will tolerate expansion, but they are too strong to utilize normal hand tools for the purpose of crimping. It is to this end that the alloy of the present invention is highly effective so that it can serve both functions efficiently and effectively, and in addition be die castable to give excellent dimensional properties as well as economies in forming.

As to the material for utilization in die casting, the prior art generally utilizes a C-85800 material which is approximately 58% copper, 40% zinc, 1% lead and 1% tin; or copper alloy C-87400 which is approximately 83% copper, 14% zinc, and 3% silicon.

The other prior art material as set forth above is C-83300 which is essentially 93% copper, 4% zinc, 1.5% lead and 1.5% tin. It is primarily a sand cast material.

As set forth above, sand cast materials such as C-83300 are expensive to form and they typically lack consistent, desirable, dimension tolerances. A sand cast Red Brass material typically is 93% copper, 4% zinc, 1.5% tin and 1.5% lead. Its solidification range is too long for die casting but is adaptable for sand casting.

Yellow Brass such as C-85800, commonly used in die casting, lacks sufficient ductility and can readily crack when crimped, but may tolerate the expansion forces of a collet-like compression nut. Yellow Brass typically is 58% copper, 40% zinc, 1% lead and 1% tin.

Silicon brasses such as C-87400 are also die castable, but are either too strong so that hand tools cannot readily crimp them, or too brittle and tend to crack easily. Silicon brass typically is 83% copper, 14% zinc, with silicon ranging from 2.5% to 4%.

The utilization of silicon can assist in upgrading the properties of the terminal connector alloy, and also permit it to be readily die castable. If the silicon content of the brass is too low, it will not be die castable. If the silicon content is too high, the material becomes so strong that commercially available crimp hand tools cannot be used for crimping.

When silicon is used for the purpose of hardening in a copper alloy, 1% silicon will trade off for about 10% of zinc. Over 5% silicon in any copper alloy can cause it to be brittle; a brittle alloy may crack or rupture when crimped or used with a compression nut, and is therefore undesirable.

The silicon employed in the present invention is electrolytically pure and comes in chunks. The chunks normally contain a mass of crystals.

The ultimate analysis of the value of the alloy in one sense may be demonstrated with a pull test. The pull test shows how well a terminal grips and makes contact with the cable to which it is attached to. The pull test utilizes standard battery cable, and then measures the force in pounds required to dislodge the stripped end of the battery cable from the connector barrel. The table of Apr. 23, 1985 (see Table below), shows that twenty terminals die cast with alloy of the present invention, having an average wall thickness of 0.0951, had an average pull test value of 1531 lbs. and ranged between 1108 and 2216 lbs. Fifteen terminals sand cast from C-833000 brass, having an average wall thickness of 0.0947, had an average pull test value of 959 lbs. and ranged between 554 and 1524 lbs. Eleven of the fifteen had a pull test value less than 1108, the lowest test value of terminals of the present invention. Five terminals die cast from C-85800 brass, had an average pull test value of 970 and ranged between 693 to 1163 lbs. Three of the five had a lower test value than the lowest test value of the terminals from the present invention. All of the terminals crimped well without cracking.

CRIMP TERMINAL TEST
(ALL WITH A T & B HAND CRIMPER SET FOR CRIMPING 2 'o' CABLE)

| PULL TEST NO | MANUFACTURER | MFG. No. | ALLOY | BARREL I.D. INCHES | BARREL O.D. INCHES | BARREL WALL INCHES | TO CRIMP PRESSURE | TO PULL OFF LBS. | RESULTS | CONCLUSIONS |
|---|---|---|---|---|---|---|---|---|---|---|
| 1A | Q-C | 5242 | 2.43 Si | .458 | .650 | .096 | 86 | 1,108 | NO CRACKING<br>8% BETTER GRIP | Terminals die cast from the new Silicon brass material 1 provided an average of 18% better grip on the cable than the FTZ terminals sand cast from C-83300 brass. All of the terminals crimped well without cracking. 1 Copper 89.5% Silicon 2.43% Zinc 7.97% |
| 1B | FTZ | FBT-2/o | C-83300 | .508 | .698<br>.705 | .100 | 63 | 1,025 | NO CRACKING | |
| 2A | Q-C | 5242 | 2.43 Si | .458 | .648 | .095 | 84 | 1,136 | NO CRACKING<br>29% BETTER GRIP | |
| 2B | FTZ | FBT-2/o | C-83300 | .494 | .685<br>.701 | .102 | 74 | 1,468 | NO CRACKING | |
| 3A | Q-C | 5242 | 2.43 Si | .458 | .652 | .097 | 98 | 1,247 | NO CRACKING<br>29% BETTER GRIP | |
| 3B | FTZ | FBT-2/o | C-83300 | .493 | .670<br>.698 | .095 | 67 | 970 | NO CRACKING | |
| 4A | Q-C | 5242 | 2.43 Si | .458 | .649 | .095 | 100 | 1,939 | NO CRACKING<br>27% BETTER GRIP | |
| 4B | FTZ | FBT-2/o | C-83300 | .498 | .696<br>.705 | .101 | 79 | 1,524 | NO CRACKING | |
| 5A | Q-C | 5242 | 2.43 Si | .458 | .646 | .094 | 90 | 1,302 | NO CRACKING<br>56% BETTER GRIP | |
| 5B | FTZ | FBT-2/o | C-83300 | .496 | .671<br>.688 | .091 | 60 | 831 | NO CRACKING | |
| 6A | Q-C | 5242 | 2.43 Si | .458 | .649 | .095 | 92 | 1,607 | NO CRACKING<br>29% BETTER GRIP | Terminals die cast from the new Silicon brass material 1 provided an average of 79% better grip on the cable than the Bil-Fro terminals sand cast from C-83300 brass. All of the terminals crimped well without cracking 1 Copper 89.5% Silicon 2.43% Zinc 7.97% |
| 6B | Bil-Fro | | C-83300 | .480 | .662<br>.672 | .093 | 68 | 1,247 | NO CRACKING | |
| 7A | Q-C | 5242 | 2.43 Si | .458 | .648 | .095 | 86 | 1,247 | NO CRACKING<br>12% BETTER GRIP | |
| 7B | Bil-Fro | | C-83300 | .480 | .664<br>.680 | .096 | .64 | 1,108 | NO CRACKING | |
| 8A | Q-C | 5242 | 2.43 Si | .458 | .648 | .095 | .86 | 1,607 | NO CRACKING<br>95% BETTER GRIP | |
| 8B | Bil-Fro | | C-83300 | .482 | .665<br>.674 | .093 | .69 | 831 | NO CRACKING | |
| 9A | Q-C | 5242 | 2.43 Si | .458 | .645 | .093 | .91 | 1,607 | NO CRACKING<br>115% BETTER GRIP | |
| 9B | Bil-Fro | | C-83300 | .481 | .660<br>.670 | .099 | .63 | 748 | NO CRACKING | |
| 10A | Q-C | 5242 | 2.43 Si | .458 | .644 | .093 | .87 | 1,385 | NO CRACKING<br>150% BETTER GRIP | |
| 10B | Bil-Fro | | C-83300 | .484 | .648<br>.670 | .087 | .56 | 554 | NO CRACKING | |
| 11A | Q-C | 5242 | 2.43 Si | .458 | .649 | .095 | .87 | 1,662 | NO CRACKING<br>50% BETTER GRIP | Terminals die cast from the new Silicon brass material 1 provided an average of 68% better grip on the cable than the AMC terminals die cast from C-85800 brass. All of the terminals crimped well without cracking 1 Copper 89.5% Silicon 2.34% Zinc 7.97% |
| 11B | AMC | TB1493 | HEAT TREAT. C-85800 | .465 | .653<br>.660 | .095 | 89 | 1,108 | NO CRACKING | |
| 12A | Q-C | 5242 | 2.43 Si | .458 | .648 | .095 | 92 | 1,468 | NO CRACKING<br>111% BETTER GRIP | |
| 12B | AMC | TB1493 | HEAT TREAT. C-85800 | .463 | .651<br>.656 | .094 | 87 | 693 | NO CRACKING | |
| 13A | Q-C | 5242 | 2.43 Si | .458 | .650 | .096 | 98 | 2,216 | NO CRACKING | |

-continued

CRIMP TERMINAL TEST
(ALL WITH A T & B HAND CRIMPER SET FOR CRIMPING 2 'o' CABLE)

| PULL TEST NO | MANUFACTURER | MFG. No. | ALLOY | BARREL I.D. INCHES | BARREL O.D. INCHES | BARREL WALL INCHES | TO CRIMP PRESSURE | TO PULL OFF LBS. | RESULTS | CONCLUSIONS |
|---|---|---|---|---|---|---|---|---|---|---|
| | | | | | | | | | 128% BETTER GRIP | |
| 13B | AMC | TB1473 | HEAT TREAT. C-85800 | .465 | .652 .665 | .094 | 97 | 970 | NO CRACKING | |
| 14A | Q-C | 5242 | 2.43 Si | .458 | .648 | .095 | 85 | 1,385 | NO CRACKING | |
| | | | | | | | | | 51% BETTER GRIP | |
| 14B | AMC | TB1493 | HEAT TREAT. C-85800 | .465 | .647 .652 | .092 | 77 | 914 | NO CRACKING | |
| 15A | Q-C | 5242 | 2.43 Si | .458 | .650 | .096 | 92 | 1,253 | NO CRACKING | |
| | | | | | | | | | 7% BETTER GRIP | |
| 15B | AMC | TB1493 | HEAT TREAT. C-85800 | .465 | .652 .657 | .094 | 95 | 1,163 | NO CRACKING | |
| 16A | Q-C | 5242 | 2.43 Si | .458 | .652 | .097 | 98 | 1,579 | NO CRACKING | Terminals die cast from the new Silicon brass material 1 provided an average of 110% better grip on the cable than the AMP terminals sand cast from C83300 Brass. All of the terminals crimped well without cracking |
| | | | | | | | | | 127% BETTER GRIP | |
| 16B | AMP | 604962 | C-83300 | .495 | .670 .692 | .093 | 71 | 693 | NO CRACKING | |
| 17A | Q-C | 5242 | 2.43 Si | .458 | .644 | .093 | 88 | 1,302 | NO CRACKING | |
| | | | | | | | | | 56% BETTER GRIP | |
| 17B | AMP | 604862 | C-83300 | .494 | .670 .680 | .090 | 66 | 831 | NO CRACKING | |
| 18A | Q-C | 5242 | 2.43 Si | .458 | .652 | .097 | 99 | 2,161 | NO CRACKING | 1 Copper 89.5% Silicon 2.34% Zinc 7.97% |
| | | | | | | | | | 110% BETTER GRIP | |
| 18B | AMP | 604862 | C-83300 | .494 | .675 .690 | .094 | 74 | 1,025 | NO CRACKING | |
| 19A | Q-C | 5242 | 2.43 Si | .458 | .648 | .095 | 94 | 2,161 | NO CRACKING | |
| | | | | | | | | | 211% BETTER GRIP | |
| 19B | AMP | 604862 | C-83300 | .492 | .670 .687 | .093 | 64 | 693 | NO CRACKING | |
| 20A | Q-C | 5242 | 2.43 Si | .458 | .648 | .095 | 89 | 1,241 | NO CRACKING | |
| | | | | | | | | | 50% BETTER GRIP | |
| 20B | AMP | 604862 | C-83300 | .493 | .670 .692 | .094 | 74 | 831 | NO CRACKING | |

All of the above tests were performed uniformly and with the same equipment, irrespective of whether the prior art material was utilized, or the material of the present invention. Attention was given to the samples to make sure they were essentially free from cracks, inclusions and other imperfections. This was the procedure followed irrespective of whether the terminal was exemplary of the present invention, or exemplary of the prior art.

Although particular embodiments of the invention have been shown and described in full here, there is no such intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. A die cast terminal connector for a cable comprising:

a pair of jaws having a terminal recess there between;

a barrel connector portion which is tubular and will receive a stripped cable attached to solid jaws, whereby said barrel connector can be readily crimped, said connector being made of an alloy consisting essentially of:

copper in the amount of 85% to 93%, zinc in the amount of 5% to 12%, and silicon in the amount of 1.5% to 2.5%.

2. The connector of claim 1 wherein said alloy is further restricted to:

copper in the amount of 88% to 91%, zinc in the amount of 6% to 10%, and silicon in the amount of 1.75% to 2.4%.

3. The connector of claim 1 whereby said alloy further comprises trace elements which are tin, lead and aluminum; and each of said trace elements are present in amounts of less than 0.05%.

4. The connector of claim 2 wherein said alloy further comprises trace elements which are tin, lead and aluminum each of said trace elements are present in amounts of less than 0.05%.

5. The connector of claim 3 wherein said barrel connector has a nominal wall thickness of 0.1 in. (0.254 cm).

6. The connector of claim 4 wherein said barrel connector has a nominal wall thickness of 0.1 in. (0.254 cm).

* * * * *